US007434703B2

(12) United States Patent
Shingle

(10) Patent No.: US 7,434,703 B2
(45) Date of Patent: Oct. 14, 2008

(54) CHILD-RESISTANT TAMPER-INDICATING PACKAGE

(75) Inventor: John M. Shingle, Perrysburg, OH (US)

(73) Assignee: Rexam Prescription Products Inc., Perrysburg, OH (US)

( * ) Notice: Subject to any disclaimer, the term of this patent is extended or adjusted under 35 U.S.C. 154(b) by 496 days.

(21) Appl. No.: 10/952,146

(22) Filed: Sep. 27, 2004

(65) Prior Publication Data

US 2006/0070973 A1 Apr. 6, 2006

(51) Int. Cl.
*B65D 55/02* (2006.01)
*B65D 39/08* (2006.01)

(52) U.S. Cl. ..... 215/217; 215/252; 215/228; 215/330; 215/331

(58) Field of Classification Search ..... 215/252, 215/222, 217, 331, 256, 220
See application file for complete search history.

(56) References Cited

U.S. PATENT DOCUMENTS

| | | | | |
|---|---|---|---|---|
| 3,613,929 | A | 10/1971 | Treanor | |
| 3,880,313 | A | 4/1975 | Akers | |
| 3,917,096 | A | 11/1975 | Hedgewick | |
| 3,979,001 | A | 9/1976 | Bogert | |
| 4,016,996 | A | 4/1977 | Aichinger et al. | |
| 4,032,028 | A | 6/1977 | Reiss et al. | |
| 4,089,463 | A | 5/1978 | Babiol | |
| 4,090,629 | A | 5/1978 | Hedgewick | |
| 4,128,184 | A | 12/1978 | Northup | |
| 4,139,112 | A | 2/1979 | Cooke | |
| 4,196,818 | A * | 4/1980 | Brownbill | 215/252 |
| 4,320,844 | A | 3/1982 | Cooper | |
| 4,375,858 | A * | 3/1983 | Shah et al. | 215/217 |
| 4,387,817 | A * | 6/1983 | Wiles et al. | 215/217 |
| 4,450,973 | A * | 5/1984 | Toeppen | 215/329 |
| 4,522,307 | A | 6/1985 | Steiner | |
| 4,526,284 | A | 7/1985 | Herbert | |
| 4,567,992 | A | 2/1986 | Davis | |
| 4,573,582 | A | 3/1986 | Kusz | |
| 4,645,088 | A | 2/1987 | Menichetti | |
| 5,320,236 | A | 6/1994 | Gregory | |
| 5,423,444 | A | 6/1995 | Druitt | |

(Continued)

FOREIGN PATENT DOCUMENTS

| | | |
|---|---|---|
| CH | 607702 | 10/1978 |

(Continued)

*Primary Examiner*—Anthony D Stashick
*Assistant Examiner*—James N Smalley
(74) *Attorney, Agent, or Firm*—Reising, Ethington, Barnes, Kisselle, P.C.

(57) ABSTRACT

A tamper-indicating child-resistant package includes a container having a finish with an open mouth and an external circumferential bead spaced from the mouth. A closure has a skirt for externally encircling the container finish, a tamper band frangibly connected to the skirt for positioning beneath the external circumferential bead on the container finish, and a spring element for engaging the finish and biasing the closure away from the finish. The finish and the skirt have interlocking elements that resist removal of the closure from the finish absent force against the spring element to disengage the interlocking elements. Engagement of the tamper band with the external circumferential bead ruptures the frangible connection of the band to the skirt upon first removal of the closure from the container finish to indicate potential tampering with the package.

1 Claim, 4 Drawing Sheets

U.S. PATENT DOCUMENTS

| | | | | |
|---|---|---|---|---|
| 5,443,171 | A | 8/1995 | Sprowl | |
| 5,449,078 | A | 9/1995 | Akers | |
| 5,609,263 | A | 3/1997 | Perchepied | |
| 5,638,972 | A | 6/1997 | Druitt | |
| 5,836,464 | A | 11/1998 | Druitt | |
| 6,161,711 | A * | 12/2000 | Miceli et al. | 215/206 |
| 6,325,228 | B1 | 12/2001 | Druitt | |
| 6,378,713 | B2 | 4/2002 | Montgomery | |
| 6,382,445 | B1 | 5/2002 | McCandless | |
| 6,446,823 | B2 | 9/2002 | Miceli et al. | |
| 6,450,352 | B1 | 9/2002 | DeJonge | |
| 6,527,132 | B1 | 3/2003 | Druitt et al. | |
| 6,848,590 | B2 * | 2/2005 | Brozell et al. | 215/220 |
| 2001/0019033 | A1 | 9/2001 | Montgomery | |
| 2002/0027123 | A1 | 3/2002 | Druitt | |
| 2002/0195412 | A1 | 12/2002 | Miceli et al. | |
| 2003/0121877 | A1 * | 7/2003 | Brozell et al. | 215/220 |
| 2004/0173562 | A1 | 9/2004 | Wolfe | |

FOREIGN PATENT DOCUMENTS

| | | |
|---|---|---|
| EP | 0001010 | 3/1979 |
| EP | 1302406 | 4/2003 |
| WO | WO90/04546 | 5/1990 |

* cited by examiner

CHILD-RESISTANT TAMPER-INDICATING PACKAGE

The present invention relates to child-resistant packages, to closures and containers for such packages, and to methods of making such packages, closures and containers.

BACKGROUND AND SUMMARY OF THE INVENTION

Child-resistant closure and container packages conventionally are employed for prescription vials, vitamin bottles and a number of other applications. The present invention deals particularly with those types of child-resistant packages that involve application of an axial force on the closure while simultaneously turning the closure with respect to the container to remove the closure from the container.

A tamper-indicating child-resistant package in accordance with one presently preferred aspect of the present invention includes a container having a finish with an open mouth and an external circumferential bead spaced from the mouth. A closure has a skirt for externally encircling the container finish, a tamper band frangibly connected to the skirt for positioning beneath the external circumferential bead on the container finish, and a spring element for engaging the finish and biasing the closure away from the finish. The finish and the skirt have interlocking elements that resist removal of the closure from the finish absent force against the spring element to disengage the interlocking elements. Engagement of the tamper band with the external circumferential bead ruptures the frangible connection of the band to the skirt upon first removal of the closure from the container finish to indicate potential tampering with the package. In the preferred embodiment of the invention, the interlocking elements include at least one external thread on the container finish and a locking lug on an underside of the external thread. At least one internal thread on the skirt has an interruption for receipt over the lug, axial force on the closure being required to move the interruption out of engagement with the lug and permit removal of the closure.

A child-resistant package in accordance with another presently preferred aspect of the invention includes a container having a finish with an open mouth, an external circumferential bead spaced from the open mouth, at least one external thread between the mouth and the circumferential bead, and a locking lug on an underside of the external thread. A closure has a base wall, and a peripheral skirt extending from the base wall with at least one internal thread having an interruption for receipt over the locking lug on the container finish. A tamper band is frangibly connected to the skirt at a position spaced from the base wall, and a stop flange resiliently pivotally extends from the band for engagement with the external circumferential bead on the container finish. A projection extends from the base wall in a direction opposite from the skirt. The projection has an external surface with a portion adjacent to the base wall and an external bead spaced from the base wall. The closure also has a spring element for engaging the container finish. The closure is received on the container finish in a tamper-indicating child-resistant mode of operation with the skirt received over the finish, the threads on the finish and skirt engaged, the locking lug on the finish received in the thread interruption on the skirt, the spring element engaged with the finish to bias the closure away from the finish, and the stop flange received beneath the external circumferential bead on the finish. The closure is received on the finish in a non-child-resistant mode of operation with the projection received within the container mouth, the external surface portion sealingly engaged with the inside diameter of the container mouth and the external bead on the projection received by snap-fit within the container mouth.

BRIEF DESCRIPTION OF THE DRAWINGS

The invention, together with additional objects, features, advantages and aspects thereof, will best be understood from the following description, the appended claims and the accompanying drawings, in which:

DETAILED DESCRIPTION OF PREFERRED EMBODIMENTS

Figure 1:
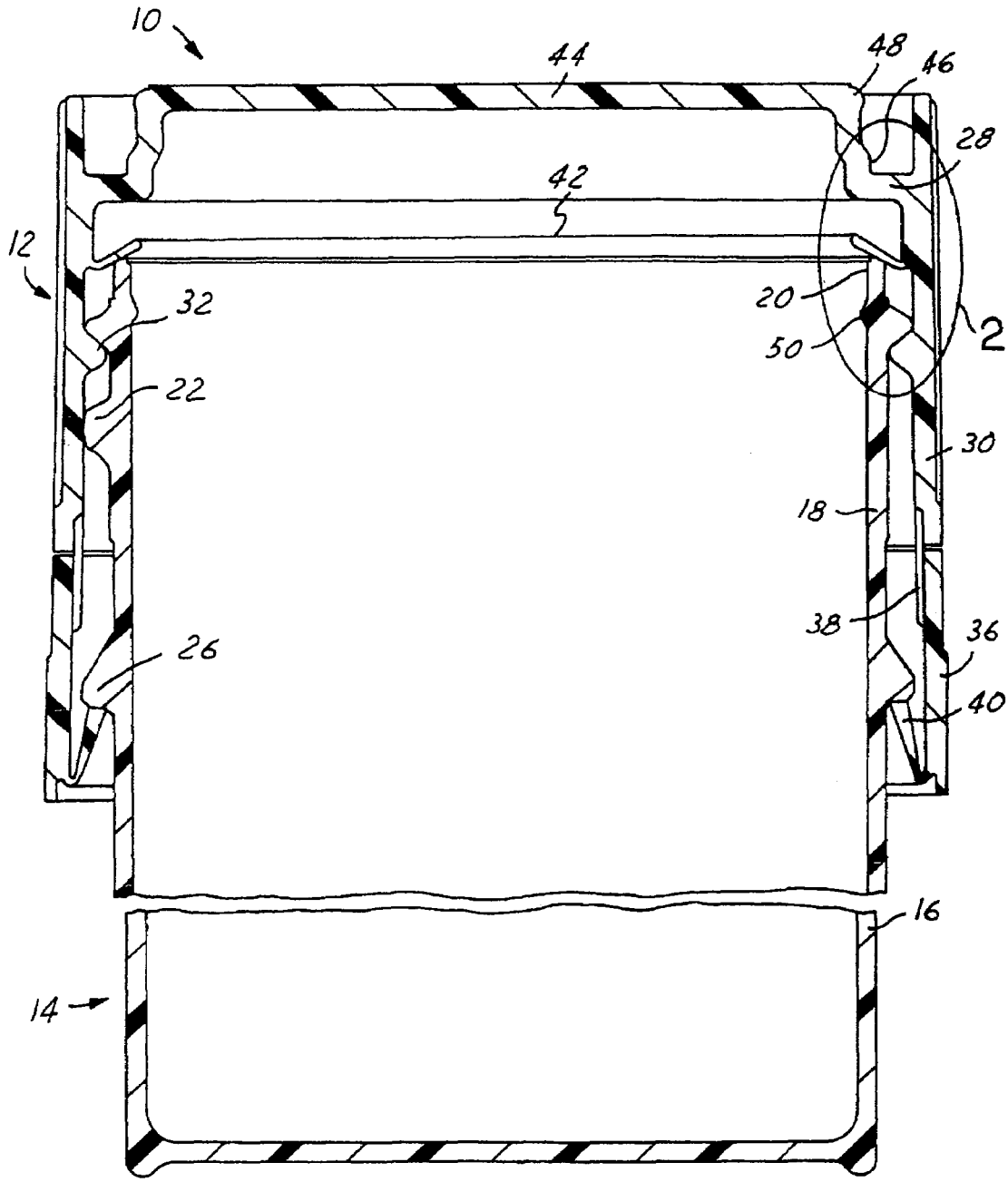
FIG. 1 is a fragmentary sectional view of a tamper-indicating child-resistant package in accordance with one presently preferred embodiment of the invention.

FIGS. 1-4 illustrate a package 10 in accordance with one presently preferred embodiment of the invention as including a closure 12 removably secured to a container 14. Container 14 (FIGS. 1-5) has a body 16 and a cylindrical finish 18 extending from the body. Body 16 may be of any suitable geometry. Finish 18 includes an open mouth 20 and at least one external thread (or thread segment) 22. Four angularly spaced thread are illustrated. Each thread 22 has a locking lug 24 extending axially from an underside of the thread at the end of the thread segment remote from the container mouth. Locking lugs 24 are substantially rectangular in the preferred embodiment of the invention. A circumferential external bead 26 extends around finish 18 at a position axially spaced from threads 22 and locking lugs 24. Bead 26 preferably is perpendicular to the axis of finish 18.

Closure 12 (FIGS. 1-4 and 6-7) preferably is of one-piece integrally molded construction that includes a base wall 28. Base wall 28 is of annular construction in the preferred embodiment of the invention, having an outer peripheral edge from which a skirt 30 axially extends. Skirt 30 has at least one internal thread (or thread segment) 32 for engagement with external threads 22 on container finish 18. Each internal thread 32 includes an interruption or gap 34 for receiving an associated locking lug 24 on container finish 18. A tamper band 36 is frangibly connected to the lower edge of skirt 30, preferably by a plurality of bridges 38 that are integrally molded on the inside surfaces of skirt 30 and band 36. (Directional words such as "lower" and "inside" are employed by way of description and not limitation with respect to the upright orientation of the closure and package illustrated in FIGS. 1-2 and 5-7. Directional words such as "axial" and "radial" are employed by way of description and not limitation with respect to the axis of the container finish or the closure skirt as appropriate.) A stop flange 40 is resiliently pivotally connected to band 36 adjacent to the lower edge of the band for engaging circumferential external bead 26 on container finish 18 in the tamper-indicating child-resistant mode of operation illustrated in FIG. 1. Stop flange 40 may be of the type illustrated in U.S. Pat. Nos. 5,443,171 and Re33, 265.

Figure 2:
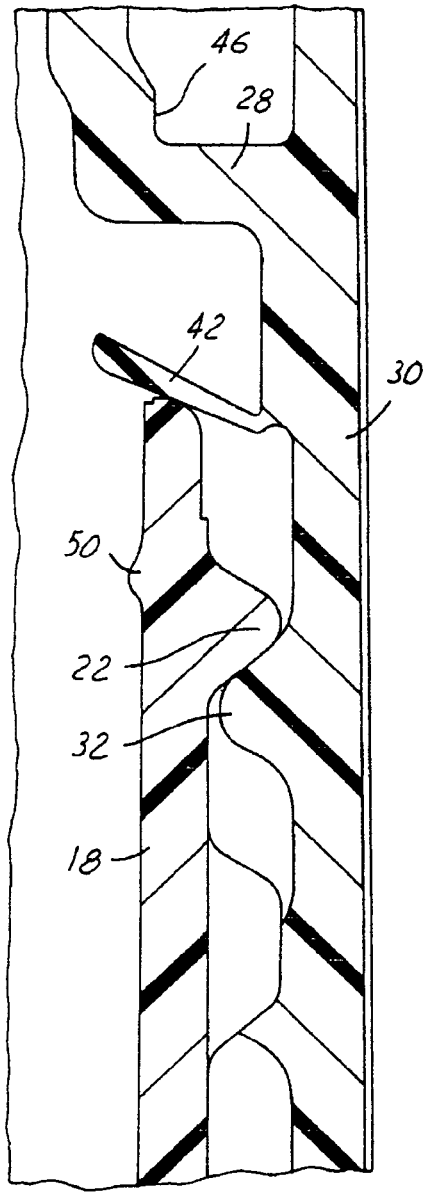
FIG. 2 is a fragmentary sectional view on an enlarged scale of the portion of FIG. 1 within the area 2.
Figure 7:
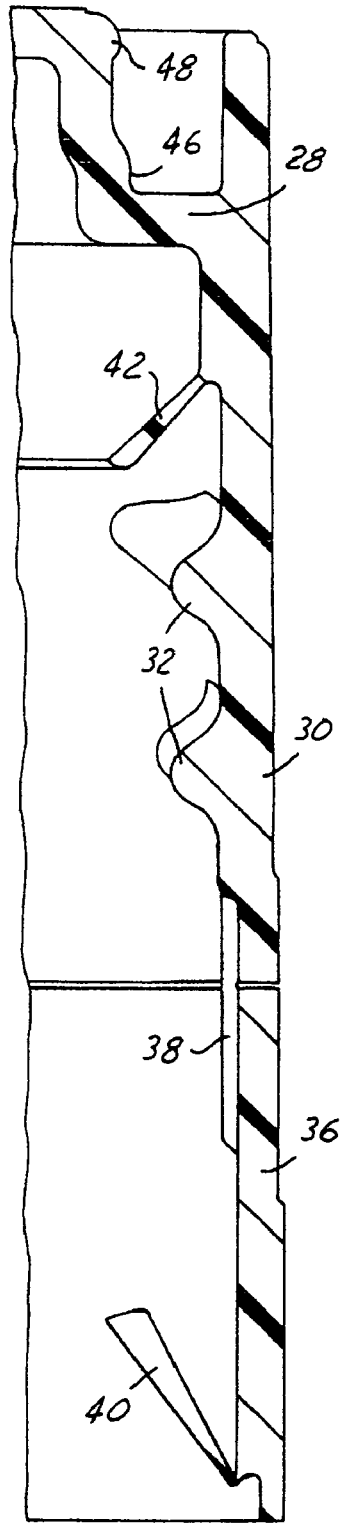
FIG. 7 is a fragmentary sectional view on an enlarged scale of a portion of the closure illustrated in FIG. 6.

A spring element 42 extends from closure 12 for engaging container finish 18 in the child-resistant mode of operation (FIGS. 1 and 2). In the preferred embodiment of the invention illustrated in the drawings, spring element 42 is of conical construction, extending radially inwardly and axially downwardly from skirt 30 at a position adjacent to but spaced from base wall 28, as best seen in FIG. 7. Spring element 42 preferably is circumferentially continuous, and preferably widens or thickens as it extends away from skirt 30. A projection 44 extends from the inner peripheral edge of base wall 28 in a direction opposite from skirt 30. Projection 44 is hollow or dome-shaped in the preferred embodiment of the invention. Projection 44 has a radially outwardly facing surface with a first portion 46 immediately adjacent to base wall 28 and a second portion spaced from base wall 28 having a radially outwardly extending circumferential bead 48. Bead 48 may be circumferentially continuous or circumferentially segmented.

In a tamper-indicating child-resistant mode of operation illustrated in FIGS. 1-2, closure 12 is received over container finish 18 with closure internal threads 32 engaged with finish external threads 22 and with locking lugs 24 on finish 18 received within interruptions or gaps 34 of closure internal threads 32. Spring element 42 engages the upper end of finish 18 to bias closure 12 axially away from container 14 and thereby hold lugs 24 within interruptions 34. Stop flange 40 of tamper-indicating band 36 is engaged beneath bead 26 on container finish 18. To remove closure 12 from container 14, it is necessary to press downwardly on closure 12 against the force of spring element 42 until interruptions 34 clear the lower ends of locking lugs 24. Closure 12 may then be turned in a counterclockwise or unthreading direction. As the closure is unthreaded from the container finish, abutment of stop flange 40 against container bead 26 retards removal of the closure and causes fracture of the frangible connection of tamper band 36 to closure skirt 30. As closure 12 thus is first removed from the package, the tamper band is frangibly separated from the closure to indicate that the package has been opened. Closure 12 thereafter may be threaded onto and off of the container in a child-resistant mode.

Figure 3:
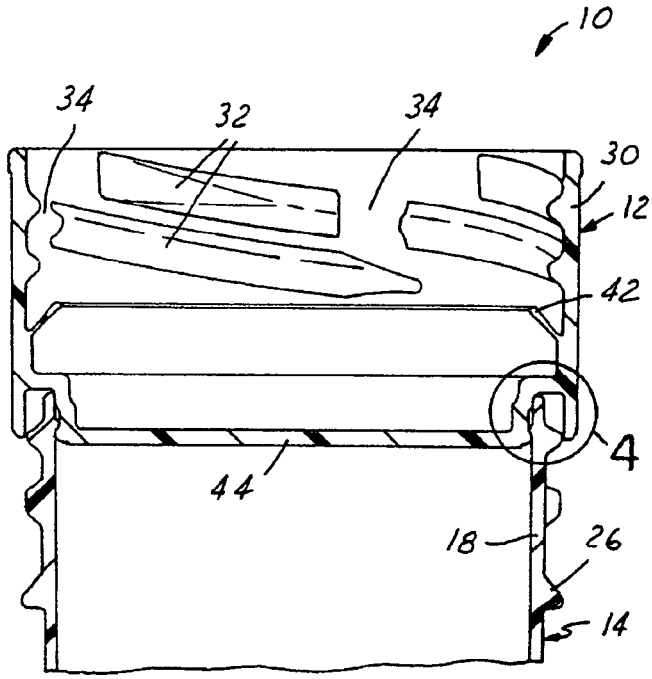
FIG. 3 is a fragmentary sectional view of the package of FIGS. 1 and 2 with the closure mounted to the container in a non-child-resistant mode.
Figure 4:
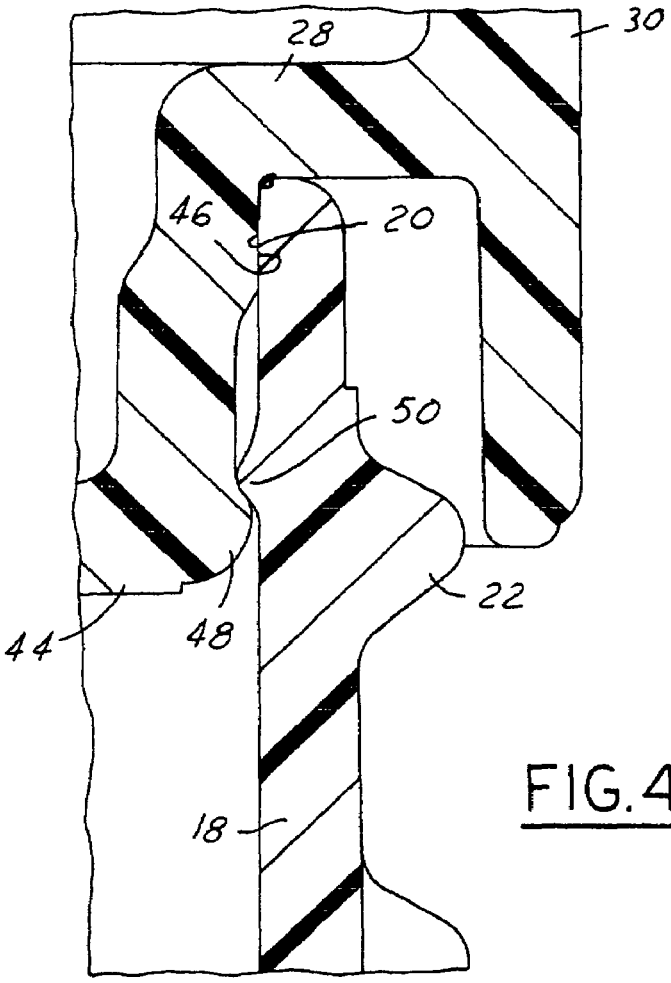
FIG. 4 is a fragmentary sectional view of the portion of FIG. 3 within the area 4.
Figure 5:
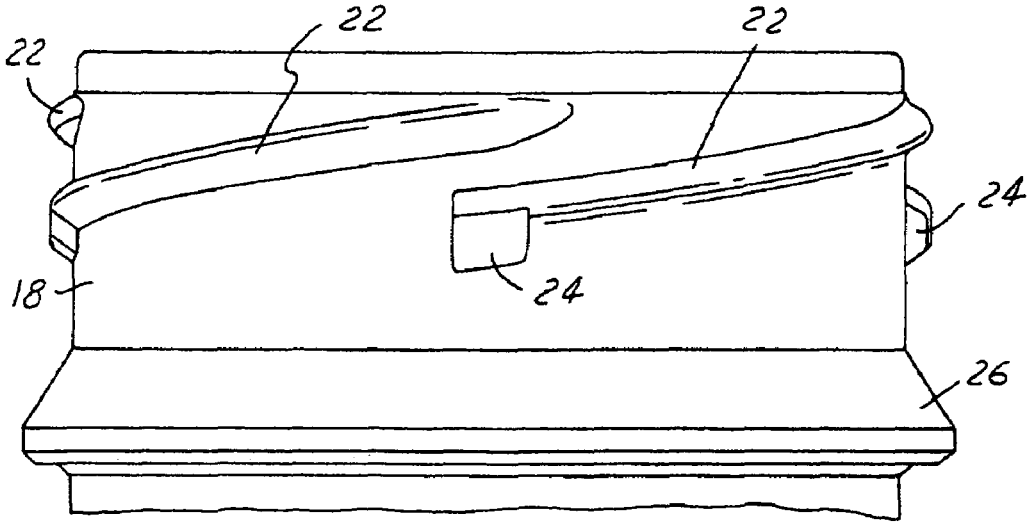
FIG. 5 is a fragmentary elevational view of the container in the package of FIGS. 1-4.
Figure 6:
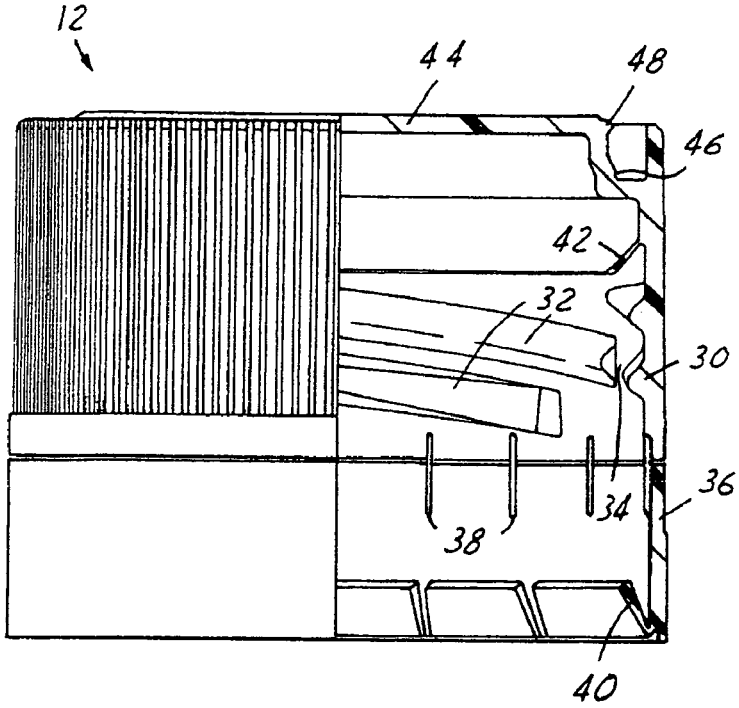
FIG. 6 is a partially sectioned elevational view of the closure in the package of FIGS. 1-4.

In a non-child-resistant mode of operation illustrated in FIGS. 3 and 4, closure 12 is inverted and closure projection 44 is received within container mouth 20. External surface portion 46 on projection 44 is in plug-sealing surface-to-surface engagement with the inside diameter of container mouth 20, and external bead 48 on projection 44 is received by snap-fit over an internal bead 50 within the container finish spaced from the open end of the finish. (Bead 50 could be replaced by an internal circumferential groove.) Closure 12 thus is secured to the container finish in an inverted non-child-resistant mode of operation, and with the package sealed by abutment of closure surface 46 with the inside diameter of the container mouth.

Closure 12 and container 14 may be of any suitable material constructions, preferably plastic such as polypropylene.

There thus have been disclosed a child-resistant package, a closure and a container for such a package, and methods of making such a closure, container and package that fully satisfy all of the objects and aims previously set forth. The invention has been disclosed in conjunction with a presently preferred embodiment thereof, and a number of modifications and variations have been discussed. Other modifications and variations will readily suggest themselves to persons of ordinary skill in the art in view of the foregoing discussion. The invention is intended to embrace all such modifications and variations as fall within the spirit and broad scope of the appended claims.

The invention claimed is:

1. A child-resistant package that includes:

a container having a finish with an open mouth, and a one-piece plastic closure having a base wall, a skirt extending from said base wall, a spring element for engagement with said finish, and a projection extending from said base wall in a direction opposite from said skirt, said projection having an external surface with a portion adjacent to said base wall and an external bead spaced from said base wall, said closure being received on said finish in a child-resistant mode of operation with said skirt received over said finish, and said spring element engaged with said finish to bias said closure away from said finish, said closure being received on said finish in a non-child-resistant mode of operation with said projection received within said mouth, said external surface portion of said projection adjacent to said base wall in sealing engagement with an inside diameter of said mouth and said external bead on said projection received by snap-fit within said mouth, wherein said container finish has an external circumferential bead spaced from said mouth, at least one external thread between said mouth and said bead, and a locking lug on an underside of said external thread, said closure skirt has at least one internal thread with an interruption for receipt over said locking lug, a tamper band frangibly connected to said skirt at a position spaced from said base wall and a stop flange resiliently pivotally coupled to said band for engagement with said external circumferential bead on said finish, said internal thread on said skirt being engaged with said external thread on said container, said locking lug on said finish being received on said thread interruption on said closure, and said stop flange being received beneath the said external circumferential bead in said child-resistant mode of operation to provide tamper indication by separation of said tamper band from said skirt upon first pressing said closure against said spring element until said interruptions clear said lugs and said closure is first unthreading from said container, and said spring element extends radially inwardly from said skirt at a position on said skirt spaced from said base wall to engage an end surface of said finish.

* * * * *